United States Patent [19]

Kaiser et al.

[11] 4,140,480

[45] Feb. 20, 1979

[54] HOT CUPOLA GAS BURNER

[75] Inventors: Francis T. Kaiser; Norman P. Lillybeck, both of Port Washington, Wis.; Rodney H. Schueller, Moline, Ill.

[73] Assignee: Modern Equipment Company, Port Washington, Wis.

[21] Appl. No.: 816,381

[22] Filed: Jul. 18, 1977

[51] Int. Cl.[2] ..... F27B 3/22

[52] U.S. Cl. ..... 432/22; 266/156; 266/199; 266/900; 432/96; 432/101

[58] Field of Search ..... 432/3, 72, 95, 96, 101, 432/22; 266/156, 199, 900

[56] References Cited

U.S. PATENT DOCUMENTS

| | | | |
|---|---|---|---|
| 3,386,365 | 6/1968 | Jensen | 432/22 |
| 3,423,080 | 1/1967 | Keyser | 432/95 |
| 3,545,918 | 12/1970 | Frondl et al. | 266/900 X |
| 3,958,919 | 5/1976 | Kjell-Berger | 266/156 |

*Primary Examiner*—John J. Camby

*Attorney, Agent, or Firm*—Meyer, Tilberry & Body

[57] ABSTRACT

A pilot flame to be positioned close to the charge opening of a cupola which uses carbon monoxide as a fuel in the presence of a fresh supply of combustion air, such carbon monoxide being drawn off from a position on the cupola where the temperature is above the self-ignition temperature of the carbon monoxide. Air preheated to a temperature above the self-ignition temperature of carbon monoxide may also be supplied.

13 Claims, 4 Drawing Figures

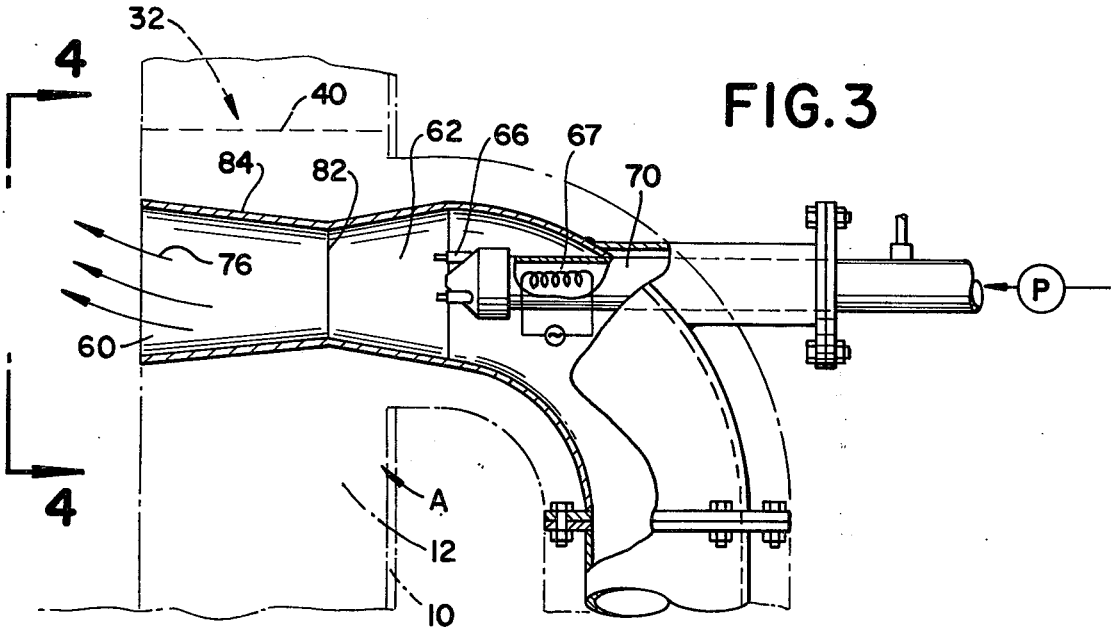
FIG. 3
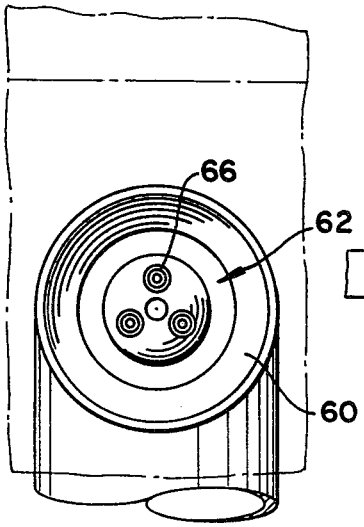
FIG. 4
FIG. 2
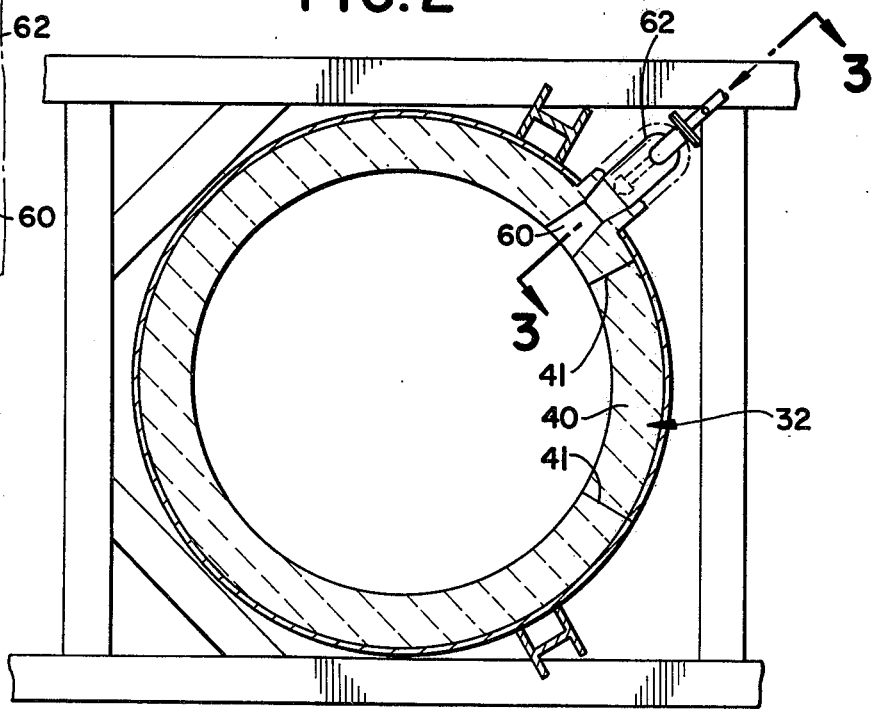

HOT CUPOLA GAS BURNER

This invention relates to the art of shaft furnaces and cupolas, and, more specifically, to a method and means for maintaining a pilot flame adjacent the charge opening for igniting burnable gases flowing past the charge opening.

Cupolas for the melting of metal normally consist of an elongated, vertical cylinder having: a charge opening adjacent the top through which coke, pieces of metal to be melted and usually flux are fed; tuyeres spaced from the lower end for injecting combustion air; and, a hearth at the bottom into which molten metal and molten slag can flow to be subsequently drawn off and in the case of the molten metal, cast into desirable shapes or in the case of the slag disposed of. The upper end of the cupola communicates either directly to air pollution control devices or through suitable duct work to air preheaters for the combustion air admitted through the tuyeres. In either event, hot gases of combustion are drawn upwardly through the cupola past the charge opening and then out of the top of the cupola.

In cupolas, the air is injected through the tuyeres under pressure and the oxygen thereof combines with incandescent coke to form carbon dioxide and produce heat. The heat melts the metal and the flux. The hot gases of combustion then flow upwardly through the cupola preheating the downfeeding coke and metal. As soon as all of the oxygen opposite the tuyeres is consumed, the hot coke above the tuyeres acts as a reducing agent on the upflowing gases to reduce a portion of the carbon dioxide to carbon monoxide in an endothermic reaction. The amount of carbon monoxide produced and the ratio of it to the carbon dioxide is a function of the coke temperature and the length of time that the gases remain in contact with the coke at elevated temperatures. In any event, there are substantial amounts of carbon monoxide flowing vertically upwardly through the furnace and past the charge opening. It is necessary that this carbon monoxide be burned so that its heat of combustion can be recovered in the air preheaters and/or to prevent the discharge of deadly carbon monoxide into the atmosphere.

In a cupola, the static pressure of the gases opposite the tuyeres is above atmospheric due to the pressure in the tuyeres and the rapid expansion of the gases as they are heated adjacent the tuyeres. This static pressure decreases as the gases flow upwardly due to the resistance of the downfeeding coke and metal. At the charge opening, which is above the top of the feed stock, the static pressure is normally below atmospheric due to the draft effect caused by the stack of the cupola or by suction fans in the ductwork communicating the top of the cupola with the air preheaters. Thus, there is normally an inward flow of air through the charge opening which mixes with the upflowing carbon dioxide and oxygen.

Normally, by the time the combustion gases have reached the charge opening, they have been cooled by the downfeeding coke and metal sufficiently that they are below the self-ignition temperature of the carbon monoxide such that when the air flows into the cupola through the charge opening, the carbon monoxide will not ignite.

Heretofore, it has been the practice to provide a pilot flame adjacent the charge opening such that when the oxygen of the air entering through the charge opening comes into contact with the carbon monoxide, the carbon monoxide will immediately ignite and be converted to carbon dioxide. This, of course, results in an exothermic reaction and normally the heat is recovered through the use of air preheater heat exchangers.

Heretofore, the pilot flame has been a gas burner adjacent the charge opening and supplied with a hydrocarbon fuel such as natural gas. When using natural gas, various igniting devices are required adjacent the burner. Additionally, safety requirements require that there be equipment to sense whether there is a flame present and if not then to shut off the supply of natural gas to the burner. Heretofore, it has been required to encase this equipment and the gas burner with refractory. Because the refractory and flame sensing equipment are fragile, it has been the practice to position the burner or burners at the side(s) of the charge opening or even at the top which are not considered to be desirable positions for optimum ignition of the CO gases.

The present invention contemplates a new and improved cupola pilot flame arrangement and method of operating same wherein the above referred to difficulties and others are overcome and a self-igniting pilot flame is provided which does not require an external supply of natural gas.

In accordance with the invention, a standard cupola having tuyeres spaced from the lower end thereof and a charge opening in its side wall adjacent the upper end thereof, is provided with: a gas take-off port positioned above the tuyeres and below the lower edge of the charge opening and within the reducing zone of the cupola through which hot carbon monoxide gas, at a temperature above its self-ignition temperature, can be withdrawn from the cupola; a burner subjacent to the charge opening of the cupola and means for causing such hot gases to be injected together with a combustion-supporting gaseous medium through the burner into the cupola at the charge opening. The take-off port must be positioned relative to the tuyeres at a location within the reducing zone of the cupola such that gases have a static pressure above atmospheric and are at a temperature above the self-ignition temperature of carbon monoxide so that when mixed with air at the burner, the carbon monoxide immediately ignites.

Further in accordance with the invention, means are provided for supplying a combustion-supporting gaseous medium such as air to the burner along with the carbon monoxide so that the carbon monoxide will be ignited before it flows so far into the charge opening that its temperature is reduced below the self-ignition temperature of the carbon monoxide. Preferably, such means are in the form of an air aspirator at the burner which air provides some of the oxygen for the hot carbon monoxide immediately as it exits the burner. There will be thus formed a continuous pilot flame in the cupola directed thereinto from the burner at a point adjacent and below the cupola charge opening and extending upwardly in the cupola across the charge opening from therebelow so as to ignite any carbon monoxide flowing upwardly in the cupola when it is mixed with the oxygen of the air flowing inwardly through the charge opening.

Preferably, the air or other combustion-supporting gaseous medium which is admixed with the carbon monoxide gases within the burner is preheated to a temperature above the self-ignition temperature of carbon monoxide so that if for any reason, e.g. start-up or cut-back, the temperature of the carbon monoxide being supplied to the burner has dropped below its self-ignition temperature, it will quickly be raised above this temperature and ignited.

Obviously, a small natural gas or oil pilot burner and/or an electrical igniter may be provided to take care of the situation where the carbon monoxide injected through the burner has been cooled below its self-ignition temperature although this is undesirable because it involves complying with certain safety regulations not present when only carbon monoxide generated internally of the cupola is involved.

Further in accordance with the invention a method of operating a coke burning cupola having a charge opening and tuyeres positioned below the opening is provided comprised of the steps of: drawing off carbon monoxide gases from the cupola above the tuyeres at a temperature above the self-ignition temperature of carbon monoxide; and, injecting such hot carbon monoxide into said cupola at a point adjacent the charge opening and admixed with oxygen whereby to provide a pilot flame for igniting carbon monoxide gases in the cupola adjacent said charge opening.

Further in accordance with the invention, the take-off port or ports for the hot gases is water cooled so that particles of ash or the like which are entrained in the flowing gases and impinge on the walls of the port do not stick thereto.

Further in accordance with the invention, the above described conducting tube leads from the lower portion of the cupola at an angle which is acute with respect to the vertical axis of the cupola so that particulate solids which might be entrained in the gas stream within the tube will fall by gravity back into the cupola thereby preventing build-up of flue dust or like materials within the tube.

It is therefore a principal object of this invention to eliminate the need for a natural gas fuel pilot flame for combusting carbon monoxide gas in the upper portions of a cupola.

It is a further object of this invention to utilize hot carbon monoxide gas produced within the cupola as the fuel gas for a pilot flame adjacent the charge opening, the hot gas being self-igniting.

It is a further object of the invention to provide an arrangement for withdrawal of carbon monoxide from a cupola which avoids the pick-up of flue dust within a conduit leading from a lower portion of a cupola to an area adjacent the sill of the charge opening.

These and other objects of the invention will appear through the understanding of a more detailed description of the invention which will be described hereinafter as a preferred embodiment thereof and as illustrated in the accompanying drawings forming a part of this specification in which:

FIG. 2 is a cross sectional view of FIG. 1 taken along line 2—2 looking downwardly into the cupola;

FIG. 3 is a cross sectional view on an enlarged scale of FIG. 2 taken on the line 3—3 showing the preferred burner head used in the present invention; and, FIG. 4 is an end view of the burner head taken on the line 4—4 of FIG. 3.

Figure 1:
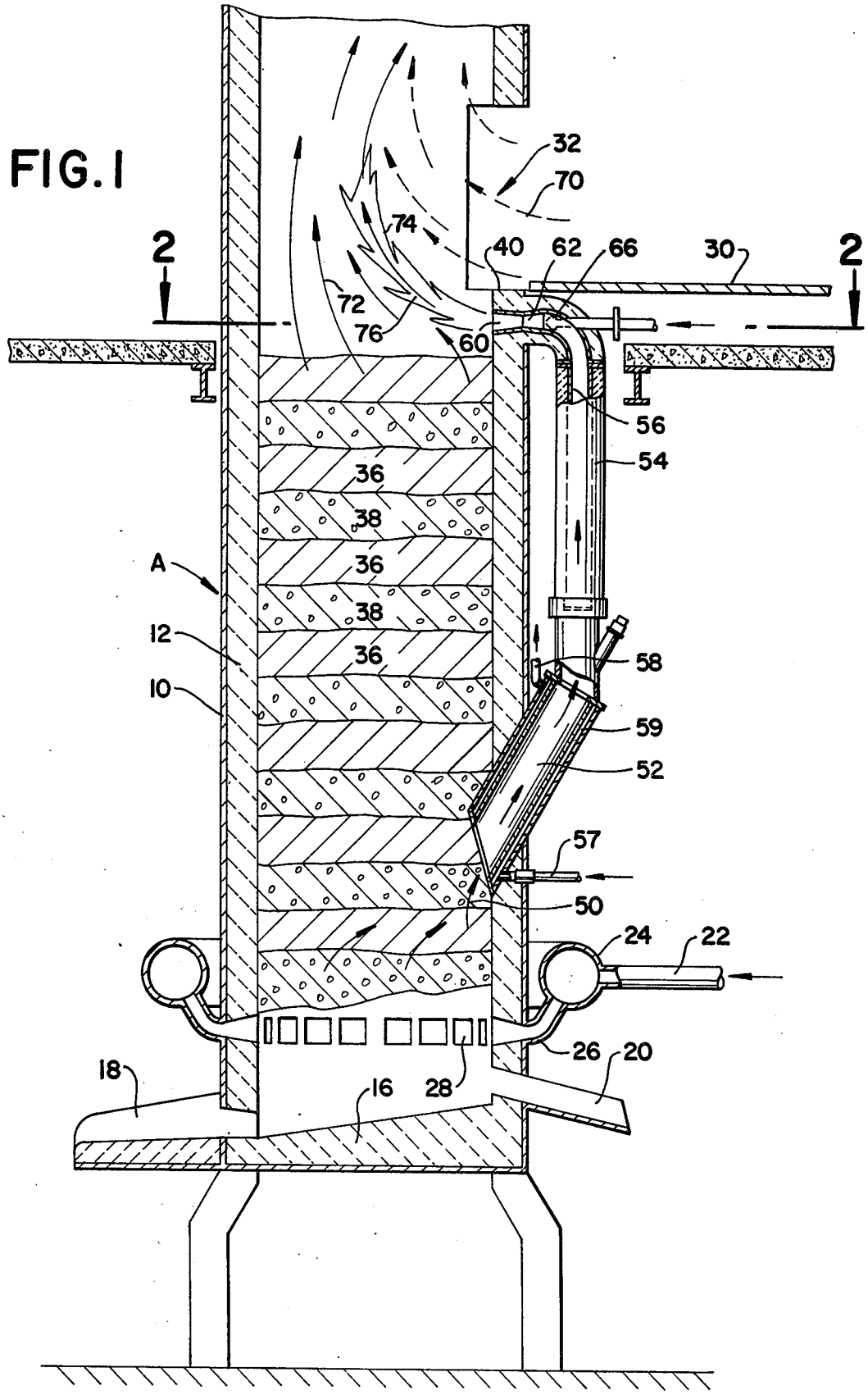
FIG. 1 is a cross section of a cupola illustrating a preferred embodiment of the invention.

Referring now to the drawings wherein the showings are for the purpose of illustrating a preferred embodiment of the invention and not for the purposes of limiting same, FIG. 1 shows a cupola A of standard configuration comprised of vertically extending, cylindrical steel outer lining 10 and an inner lining 12 of refractory material or water-cooled steel forming a vertical cylindrical shaft and a hearth 16. A molten metal tap spout 18 leads outwardly from the interior of the shaft at the top of hearth 16. A slag spout 20 is located slightly above the hearth 16 for drawing off molten slag material from the cupola.

An air supply conduit 22 leads from blowers (not shown) into doughnut shaped wind box 24 encircling the cupola shaft. Tuyeres 26 lead from wind box 24 to openings 28 located within the cupola above the hearth 16.

A charging platform 30 is located a distance above the tuyeres 26 for charging material to the cupola through a charge opening 32 in the side of the cupola, it being understood that the charge opening may take any form common in the art depending on the size of the cupola and the type of mechanism used for charging the cupola. Doors (not shown) may be provided. This opening is located above the tuyeres 26 and below the top of the cupola. The cupola extends above the charge opening 32 for a sufficient distance as to create an upward draft through the cupola and past the charge opening 32 and then is exhausted either by venting to the atmosphere or and more usually the portion above the charge opening 32 communicates to large exhaust fans.

The cupola interior is charged through charge opening 32 with alternating layers of metal 36 and coke and flux 38 extending upwardly to a point immediately below the sill 40 of charge opening 32.

Static gas pressures within the cupola vary from a maximum above atmospheric adjacent the tuyeres to a minimum below atmospheric above the upper surface of the feedstock, past the charge opening to the exhaust fans. In any event, there is always a negative pressure at the charge opening 32 such that there is a continuous inflow of outside air through the opening 32 at all times during the operation of the cupola.

To this basic cupola structure which itself constitutes no portion of the present invention, a take-off opening 50 is provided in the side of the cupola through outer shell 10 and refractory lining 12 at a point vertically above the tuyeres 26 and below charge opening sill 40 and within the reducing zone of the cupola. This opening is located in a water cooled conduit 52 extending outwardly and upwardly through the shell 10. Conduit 50 may take a number of different forms but in the preferred embodiment is comprised of a double walled tube defining an interior space 59 having a water inlet 57 at the lower end and a water outlet 58 at the upper end. This water cooling avoids a problem of slag particles impinging on and sticking to the walls of the conduit 52.

The conduit 52 in turn communicates to a vertically extending duct 54 having a refractory, i.e., heat-insulating liner 56. Duct 54 extends upwardly to an opening 60 through the outside wall 10 and refractory lining 12 of the cupola immediately below charge opening sill 40. A combustion chamber 62 is formed just in advance of this opening 60 and conduit 54 feeds hot carbon monoxide gases thereto. An air nozzle 66 extends into chamber 62 and injects a combustion supporting gaseous medium such as air, preheated if desired as will appear, where the carbon monoxide gas ignites to provide a pilot flame in the opening 60 and extending therefrom into the cupola and upwardly therein adjacent and across the charge door 32 of the cupola from therebelow.

Opening 50, in accordance with the invention, is located at a point above the tuyeres 26 in the reducing zone of the cupola where the gas mixture within the cupola contains large amounts of carbon monoxide and the internal temperature of the cupola under normal operating conditions is at least above the self-ignition temperature of the carbon monoxide gas in the presence of air; and preferably approximately 1300°–1400° F. Various sources give slightly different self-ignition temperatures for carbon monoxide when mixed with air but they all approximate 1150° F. Also, the take-off opening 50 is located where the static pressures inside the cupola are above atmospheric. Inasmuch as the static pressure at the charge opening is below atmospheric, there will be a ready flow of hot gases through the conduits 52, 54 and burner 62.

The exact vertical location of opening 50 above the tuyeres and in the reducing zone of the cupola may differ for different cupolas. Generally it may be located approximately one third of the distance between the tuyeres 28 and the charge opening 32. Here sufficient reduction of the carbon dioxide has taken place to provide a substantial percentage of carbon monoxide in the take-off gases and the gases are still at an elevated temperature. More than one take-off port may be provided at various vertical positions and valves may be provided to control the amount flowing through each one.

Thus carbon monoxide above its auto ignition temperature of approximately 1150° flows through opening 50 and gas conduits 52, 54 to combustion chamber 62 where it mixes with the oxygen in the combustion air supplied to this chamber and self-ignites to provide a pilot flame immediately under charge door 32.

The flow of air and cupola gases in the area adjacent the charging opening is illustrated in FIG. 1. As indicated, this is an area of reduced pressure due to the stack effect of the cupola above the opening or exhaust blowers or both. Thus, there is a large amount of infiltration air through charge opening 32 which flows in the direction of arrows 70 through the charge opening. Gases rising from the lower portion of the cupola indicated by arrow 72 pass upwardly and are deflected inwardly by the influx of air at the charge opening and create an interface 74 therebetween. It is at this interface 74 that the hot carbon monoxide gases from the lower portion of the cupola are reinjected thereinto by the burner 62 to form a flame front 76 extending along the interface 74 which is the optimum point for ignition of the waste gases of the cupola. Since burner 62 is made of steel it may be located below the charge opening sill 40 and will not be damaged by feed stock materials being charged through the charge and falling thereupon. This is contrary to prior art burners which burned natural gas and necessitated a refractory shield thereabout and thereby necessitating a location away from the optimum interface of air and cupola gases to avoid being struck with material being charged through charge opening 32.

It will be appreciated that under start-up or cut-back conditions of the cupola (or even during normal operation of the cupola) the temperature in the cupola adjacent the takeoff opening 50 may be at or fall to temperatures below the self-ignition temperature of carbon monoxide. A small natural gas pilot light of approximately 50 CFH may be employed to ignite the gases in burner 62 but this defeats one of the main purposes of the present invention, namely to avoid the use of any hydrocarbon gases and the attendant complicated governmental regulations controlling the use of such fuels. Accordingly, means are provided for supplying combustion air to the burner 62 preheated to a temperature in excess of the self-ignition temperature of carbon monoxide which means may take a number of different forms but in the embodiment shown include an electric heating element 67 (shown schematically) installed in the air supply manifold 70 for nozzles 66. This manifold communicates to a pump or blower P, capable of supplying 450–600 cubic feet of air per hour. The heating element 67 has a power rating of approximately 3.5 KW hours per hour and the air is heated to a temperature of 1200°–1500° F. This heating element may run continuously or only when the temperature of the take-off gases as they reach the chamber 62 fall below a predetermined temperature.

The construction of chamber 62 and nozzles 66 form no part of the present invention. The construction simply acts as a means for mixing the hot gases from the cupola with combustion air and injecting the resultant burning mixture into the cupola in the area immediately below the charge opening sill 40. The burner includes the nozzles 66 located within combustion chamber 62 wherein carbon monoxide gas passing upwardly from the lower portion of the cupola is mixed with the heated air and ignites. The burning mixture passes outwardly through a reduced diameter opening 82 and a conical burner head 84 into the cupola itself.

FIG. 2 illustrates the optimum positioning of the opening 60 relative to charge opening 60 sill 40. The opening is preferably located adjacent one of the vertical sidewalls 41 of the charge opening 32 below the sill 40 and offset at an angle of about 15° from the center line of charge opening 32. This allows the burner flame to be at the optimum position for igniting the interface between incoming air through the charge opening and rising gases within the cupola.

In the operation of the cupola following the charging thereof as described above, the coke bed 38 is ignited and air is injected through tuyere openings 28 to burn the coke bed 38 to produce heat and carbon dioxide gas. The heat melts the lowest metal in the column of feed stock and it flows downwardly through the coke bed and exits as molten metal through spout 18. The hot carbon dioxide gas produced now under pressure moves upwardly through the downfeeding coke bed. This coke is heated by the hot gases and reacts with the carbon dioxide therein in an endothermic reaction to produce carbon monoxide gas which continues to pass upwardly through the feed stock to the area adjacent the charge opening 32 where the gases are at a considerably lower temperature due to absorption of heat by both the endothermic reaction to form carbon monoxide and the absorption of heat by the feed stock. Also the gas pressure is below atmospheric. This carbon monoxide gas is normally below its auto ignition temperature or is quickly cooled below such temperature by the large amounts of infusion air passing into the stack through charge opening 32.

The conduit and burner system of the present invention preferably bleeds off approximately 5% of the total hot carbon monoxide gas flowing through the cupola and reinjects it at a temperature of above 1150° F. below the charge opening sill 40 through burner 62. The hot gases being at a temperature at or above the auto ignition temperature of carbon monoxide when mixed with air, they immediately ignite in the burner 62 and burn to form a pilot flame in the upper portion of the cupola. If the temperature of the hot gases by-passed into the burner 62 falls near to or below the self-ignition temperature of carbon monoxide, the heating element 67 may be turned on whereby the combustion air injected into the burner 62 is hot enough to ignite the carbon monoxide.

While there is a slight lowering of the efficiency of the cupola, this procedure eliminates the necessity for an external natural gas supply to ignite the top gases of the cupola thereby realizing an extensive savings with regard to overall fuel cost and efficiency of the cupola system.

While the invention has been described in the more limited aspects of the preferred embodiment, other embodiments thereof have beeb suggested and still others will occur to those skilled in the art upon a reading and understanding of the specification. It is intended that all such embodiments be included within the scope of the present invention as defined in the claims set forth hereinafter.

Having thus described the invention, it is claimed:

1. In a cupola for the melting of metal having at least one row of tuyeres therearound located near the base thereof and a charge opening in the side thereof spaced above the tuyeres and a burner subjacent the charge opening for providing a pilot flame directed into the cupola above the charge material therein and wherein hot carbon monoxide gas is generated in the cupola in the reducing zone space thereof between the tuyeres and the charge opening; the improvement which comprises: means through the walls of said cupola above said tuyeres for bleeding off from the reducing zone space of the cupola the hot gases therein at a temperature above the self-ignition temperature of carbon monoxide and reinjecting such gases into said cupola through said burner in admixture with a combustion supporting gaseous medium to cause the self-ignition and burning of the carbon monoxide present in said gases to produce the said pilot flame.

2. In a vertically extending cupola having tuyeres adjacent the lower end through which combustion air is injected into the inside of the cupola, a charge opening in the side of the cupola spaced above said tuyeres and adjacent the upper end of said cupola through which metal to be melted and coke are fed into the cupola, means above said charge opening causing a negative pressure at said charge opening whereby there is an inflow of air through said charge opening into and upwardly through said cupola, and a pilot burner subjacent said charge opening and directed into the cupola; the improvement which comprises: a take-off port through the walls of said cupola positioned above said tuyeres in the reducing zone space of the cupola for bleeding off therefrom a portion of the hot gases therein at temperatures above the self-ignition temperature of carbon monoxide when mixed with air, conduit means communicating said take-off port with said pilot burner, and means for injecting a combustion supporting gaseous medium into said burner whereby to cause the self-ignition and burning of the carbon monoxide present in the said portion of the hot gases withdrawn from the cupola and provide a pilot flame in the cupola adjacent said charge opening and extending upwardly in the cupola across the said charge opening from therebelow.

3. The improvement of claim 2 wherein said burner includes means for preheating said combustion supporting gaseous medium to above the self-ignition temperature of carbon monoxide.

4. The improvement of claim 2 wherein said conduit means is lined with heat insulating means whereby the carbon monoxide passing therethrough loses a minimum amount of heat.

5. The improvement of claim 2 wherein said burner is located below the sill of said charge opening.

6. The improvement of claim 2 wherein the conduit from said take-off port slopes upwardly and outwardly through the walls of said cupola.

7. The improvement of claim 2 wherein the walls of said take-off port are water cooled.

8. A method of providing a pilot flame in a cupola having air injection tuyeres located near the base thereof and a charge opening located in the side thereof a distance above said tuyeres and adjacent the upper end of said cupola, said cupola having means for creating a negative pressure at said charge opening and wherein coke is fed downwardly through said cupola from said charge opening towards and past said tuyeres, combustion air is injected through said tuyeres to burn said coke and the gases of combustion move upwardly through the cupola heating the coke above the tuyeres to an elevated temperature and the carbon dioxide of combustion of the coke is reduced to carbon monoxide as it flows upwardly in said cupola through the reducing zone thereof, said method comprising the steps of: bleeding off a small portion of the hot gases in said cupola from a point spaced above said tuyeres in the reducing zone of the cupola where the temperature therein is above the self-ignition temperature of carbon monoxide when mixed with air, injecting said withdrawn gases back into said cupola at a point subjacent said charge opening, and mixing same with air to effect self-ignition and burning of the carbon monoxide present in said withdrawn hot gases and produce a pilot flame in the cupola adjacent the said charge opening and extending upwardly in the cupola across the said charge opening from therebelow.

9. The method of claim 8 wherein air at a temperature in excess of 1200° F. is injected into said cupola in admixture with said withdrawn hot gases.

10. The improvement of claim 1 wherein the said combustion-supporting gaseous medium admixed with the hot gases reinjected through said burner into the cupola is composed of air preheated to a temperature above approximately 1200° F.

11. The improvement of claim 2 wherein the said combustion supporting gaseous medium injected into said burner is composed of air.

12. The method of claim 8 wherein the said portion of the hot gases withdrawn from said cupola comprises approximately 5% of the said hot gases.

13. The method of claim 8 wherein the said withdrawn gases are injected into the cupola in admixture with the said air.

* * * * *